United States Patent [19]

Brandolese

[11] 4,388,199

[45] Jun. 14, 1983

[54] AQUEOUS RUST-INHIBITING AND LUBRICATING COMPOSITIONS

[75] Inventor: Ernesto Brandolese, Graffignana, Italy

[73] Assignee: Snamprogetti S.P.A., Milan, Italy

[21] Appl. No.: 201,819

[22] Filed: Oct. 29, 1980

Related U.S. Application Data

[63] Continuation of Ser. No. 41,437, May 22, 1979, Pat. No. 4,273,664.

[30] Foreign Application Priority Data

Jun. 2, 1978 [IT] Italy ..... 24135 A/78

[51] Int. Cl.[3] ..... C10M 1/36

[52] U.S. Cl. ..... 252/33.6; 252/34.7; 252/49.3; 252/49.5; 252/392

[58] Field of Search ..... 252/33.6, 34, 34.7, 252/49.3, 49.5, 51.5 A, 392; 562/433, 437, 455, 553, 567

[56] References Cited

U.S. PATENT DOCUMENTS

| | | | |
|---|---|---|---|
| 2,328,727 | 9/1943 | Langer | 252/49.5 X |
| 2,604,451 | 7/1952 | Rocchini | 252/51.5 A |
| 2,699,427 | 1/1955 | Smith et al. | 252/33.6 |
| 2,959,547 | 11/1960 | Brillhart | 252/49.3 X |
| 3,003,960 | 10/1961 | Andress, Jr. et al. | 252/51.5 A X |
| 3,374,171 | 3/1968 | Davis | 252/49.3 X |
| 3,396,106 | 8/1968 | Andress, Jr. et al. | 252/33.6 |
| 3,427,245 | 2/1969 | Hotten | 252/34.7 |
| 3,945,931 | 3/1976 | Bussi et al. | 252/33.6 X |
| 4,053,426 | 10/1977 | Davis et al. | 252/34 |

FOREIGN PATENT DOCUMENTS

| | | | |
|---|---|---|---|
| 231729 | 11/1958 | Australia | 252/33.6 |

*Primary Examiner*—Andrew Metz

*Attorney, Agent, or Firm*—Morgan, Finnegan, Pine, Foley & Lee

[57] ABSTRACT

Rust-inhibiting compounds, especially for aqueous systems such as tool-lubricating emulsions for machine tools and which consist of amine salts of a number of monoaminoalkylene dicarboxylic acids are disclosed.

These rust-inhibitors are used in combination with water and an alkanolamine.

Examples and test results are given.

1 Claim, No Drawings

AQUEOUS RUST-INHIBITING AND LUBRICATING COMPOSITIONS

This is a continuation of application Ser. No. 041,437 filed May 22, 1979 and now U.S. Pat. No. 4,273,664.

This invention relates to a rust-preventing agent for aqueous systems and to a rust-inhibiting lubricating composition.

More particularly, this invention relates to a rust-preventing agent for aqueous products used in the machining of metals and a rust-inhibiting lubricant composition.

As is known in the field of water-based products for processing metals, water-soluble products are acquiring an evergrowing acceptance to replace the conventional emulgable oils.

The use of such solutions offers, in practice, a few substantial advantages over the emulsions and, among these advantages, there can be enumerated, above all, the stability, absence in such solutions to bacterial attack, the insensitivity in such solutions to the kind of water which is used and improved lubricant power, at least as compared with conventional emulgable oils.

The basic problem with these kinds of fluids is connected, however, with the requirement of imparting an efficient rust-inhibiting power thereto, which was generally achieved, heretofore, by using sodium nitrite.

The use of such a chemical, even though, on the one hand, it solves the problem of rust in ferrous materials, exhibits, on the other hand, the shortcoming of leaving on the surfaces treated therewith, a crystalline residue which, in certain cases, is conducive to originating or jamming, the sliding motions of the precision mechanisms of machine tools.

In addition, in the case where particularly heavy operative conditions during progress of which comparatively high temperature peaks are attained, there are nitrite decomposition phenomena with evolution of nitrous vapors which occur and thus apparent damage to workers who are subjected to the vapors.

In addition to the foregoing shortcomings, there is also to be considered the toxicity of the nitrite to microorganisms and fish, and, recent specifications which govern the discharge of waste waters have established a top limit of 0.6 ppm (parts per million) of nitrite as the maximum which can be tolerated in waste waters.

It has quite surprisingly been found that the drawbacks enumerated above can be overcome by replacing the nitrite with water soluble amine salts of a few particular organic acids.

An object of the present invention is to provide a rust-preventing composition for ferrous materials in which the rust-inhibiting effect is attained by water soluble diamine salts of a few particular organic acids, such as, for example, those belonging to the family of the monoamido-alkylene carboxylic acids having the general formula:

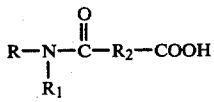

$$R-\underset{\underset{R_1}{|}}{N}-\overset{\overset{O}{\|}}{C}-R_2-COOH \quad (1)$$

wherein:

R is an alkyl radical having from 1 to 18 carbon atoms, or a phenyl group, or a phenyl group substituted by F, Cl, Br or $NO_2$ or, lastly, an alcoholic radical having from 2 to 5 carbon atoms;

$R_1$ is a hydrogen atom, or an alkyl radical having from 1 to 4 carbon atoms, or radical having from 2 to 5 carbon atoms or a polyoxyethylene group or a polyoxypropylene group having a degree of oxyethylation, or oxypropylation, respectively, between 1 and 20;

$R_2$ is an alkylene group having from 1 to 8 carbon atoms, or an alkenyl group —CH=CH—.

Summing up, the salts according to the invention can be defined as the amine salts of the secondary monoamides and tertiary monoamides of the homolog series of the dicarboxylic acids having from 3 to 10 carbon atoms, wherein the two substituents bound to the amide nitrogen are selected, from an alkyl radical having from 1 to 18 carbon atoms, a phenyl radical, a phenyl radical substituted by F, Cl, Br or $NO_2$, an alcoholic radical having from 2 to 5 carbon atoms and the other substituent is selected from hydrogen, an alkyl radical having from 1 to 4 carbon atoms, an alcoholic radical having from 2 to 5 carbon atoms, an oxyethylene radical, an oxypropylene radical, or a mixed oxyethyleneoxypropylene radical having a degree of oxyethylation or oxypropylation, respectively, of from 1 to 20.

As nonlimiting examples of acidic compounds which can be used in preventing the present invention are those compounds having the general formula (1) and exemplified by the following acids:

N-methylanilido maleic acid, N-ethylanilido maleic acid, N-ethanolanilido maleic acid, N-(2-hydroxypropyl)anilido maleic acid, N-methyl anilido malonic acid, N-ethyl anilido malonic acid, N-ethanol anilido malonic acid, N-(2-hydroxypropyl)anilido malonic acid, N-methyl anilido succinic acid, N-ethyl anilido succinic acid, N-ethanol anilido succinic acid, N-(2-hydroxypropyl)anilido succinic acid, N-methyl anilido glutaric acid, N-ethyl anilido glutaric acid, N-ethanol anilido glutaric acid, N-(2-hydroxypropyl)anilido glutaric acid, N-methyl anilido adipic acid, N-ethyl anilido adipic acid, N-ethanol anilido adipic acid, N-(2-hydroxypropyl)anilido adipic acid, N-methyl anilido pimelic acid, N-ethylanilido pimelic acid, N-ethanol anilido pimelic acid, N-(2-hydroxypropyl)anilido pimelic acid, N-methyl anilido suberic acid, N-ethyl anilido suberic acid, N-ethanol anilido suberic acid, N-(2-hydroxypropyl)anilido suberic acid, N-methyl anilido azelaic acid, N-ethyl anilido azelaic acid, N-ethanol anilido azelaic acid, N-(2-hydroxypropyl)anilido azelaic acid, N-methyl anilido sebacic acid, N-ethyl anilido sebacic acid, N-ethanol anilido sebacic acid, N-(2-hydroxypropyl)anilido sebacic acid, N-methyl-N-ethanolamido maleic acid, N-ethyl-N-propanolamido maleic acid, N-dimethylamido maleic acid, N-diethanolamido maleic acid, N-methyl-N-ethanolamido malonic acid, N-ethyl-N-propanolamido malonic acid, N-dimethylamido malonic acid, N-diethanolamido malonic acid, N-methyl-N-ethanolamido succinic acid, N-ethyl-N-propanolamido succinic acid, N-dimethylamido succinic acid, N-diethanolamido succinic acid, N-methyl-N-ethanolamido glutaric acid, N-ethyl-N-propanolamido glutaric acid, N-dimethylamido glutaric acid, N-diethanolamido glutaric acid, N-methyl-N-ethanolamido adipic acid, N-ethyl-N-propanolamido adipic acid, N-dimethylamido adipic acid, N-diethanolamido adipic acid, N-methyl-N-ethanolamido pimelic acid, N-ethyl-N-propanolamido pimelic acid, N-dimethylamido pimelic acid, N-diethanolamido pimelic acid, N-methyl-N-ethanolamido suberic acid, N-ethyl-N-propanolamido suberic acid, N-dimethylamido suberic acid, N-diethanolamido suberic acid, N-methyl-N-ethanolamido azelaic acid, N-ethyl-N-propanolamido azelaic acid, N-dimethylamido azelaic acid, N-diethanolamido azelaic acid, N-methyl-N-ethanolamido sebacic acid, N-ethyl-N-propanolamido sebacic acid, N-dimethylamido sebacic acid, N-diethanolamido sebacic acid, and other acids.

Amines which can be used for the preparation of the salts of the monoamidoalkylenedicarboxylic acids are all those amines which are capable of giving water soluble salts with such acids, such as: mono-, di- and trimethylamine, mono-, di- and triethylamine, monoisopropylamine, mono- and dibutylamine, 3-methoxypropylamine, trimethylpentamine, mono-, di- and triethanoloamine, mono-, di- and triisopropanolamine, aliphatic amines, possibly oxyethylated and oxypropylated to improve their water solubility.

Among the compounds which are particularly and advantageously used according to the invention, there will be indicated the amine salt which is the monoamide of adipic acid with propanolaniline, wherein the acidic function of the amide is achieved with tri-, di- or monoethanolamines, the amine salt which is the monoamide of adipic acid with aniline, the latter having been oxyethylated with 5 moles of ethylene oxide, wherein the acidic function of the amide concerned is salified by a mono-, di- or a triethanolamine, the amine salt which is the monoamide of the maleic acid with p.nitro-N-methylaniline, wherein the acidic function of the amide is salified by mono-, di- or triethanolamine, the amine salt which is the monoamide of the glutaric acid with the dodecylamino-N-(polyoxyethylene)amine with a degree of oxyethylation equal to 10, in which the amide is salidified by mono-, di- or triethanolamine.

The salts according to the invention are used in aqueous solution at a concentration of from 0.5% to 50% by wt, individually or in admixtures. The salts according to the invention, especially when the acidic function of the amide is salified by mono-, di- or triethanolamine, are advantageously admixed, so as to improve the lubricating power of the composition, preferably with a water soluble, oxyethylated-oxypropylated polyglycol at a concentration of from 0.1% to 20% by wt relative to the salt.

For the preparation of the salts, the acids and the amines can be used in the stoichiometric ratios, or, more particularly, an excess of amine can be employed (ratio of the amine to the acid between 1.5 and 3).

In practice, for reasons costs and of lower toxicity there are used, preferentially, salts of mono-, di- and, above all, triethanolamine, it being generally preferred to operate with an excess of the amine base (usually 1 mol of acid for 2 mols of base).

A few examples will now be reported in order to illustrate the invention more clearly without, however, limiting it in any way.

EXAMPLE 1

This is a composition containing 30% of triethanolamine, 30% of water and 40% of rust-preventing agent composed by the triethanolamine salt of the N-ethanolanilido maleic acid having the formula:

$$C_6H_5-N-(CH_2-CH_2OH)-\overset{\overset{\displaystyle O}{\|}}{C}-CH=CH-COOH$$

in which the ratio acid-to-base is 1 to 2.

The rust-inhibiting power of this composition, assessed with the IP 125 test, is such as to give no corrosion on iron at a dilution in water of 1 to 60 (IP 125 test positive to 1.5%). For IP 125 test it is intended herein to refer to the standard corrosion test prescribed in the specifications published by the Institute of Petroleum under the No. 125.

EXAMPLE 2

This is a composition containing 30% of triethanolamine, 30% of water and 40% of the rust-preventing triethanolamine salt of the N-(2-hydroxypropyl)anilido adipic acid having the formula:

$$C_6H_5-N-(CH_2-CHOH-CH_3)-\underset{\underset{\displaystyle O}{\|}}{C}-(CH_2)_4-COOH$$

in which the acid-to-base ratio is 1 to 2.

The rust-inhibiting power of this composition, evaluated with the IP 125 test, is such as not to give corrosion on iron at a dilution in water of 1 to 200 (IP 125 test positive to 0.5%).

EXAMPLE 3

This is a composition containing 30% of triethanolamine, 30% of water and 40% of the rust-preventing triethanolamine salt of the N-(2-hydroxypropyl)anilido succinic acid having the formula:

$$C_6H_5-N-(CH_2-CHOHCH_3)-\underset{\underset{\displaystyle O}{\|}}{C}-(CH_2)_2-COOH$$

in which the acid-to-base ratio is $\frac{1}{2}$.

This composition has an IP 125 test which is positive to 2%.

EXAMPLE 4

This is a composition containing 30% of triethanolamine, 30% of water and 40% of the rust-inhibiting triethanolamine salt of the N-methyl anilido glutaric acid having the formula:

$$C_6H_5-N-(CH_3)-\underset{\underset{\displaystyle O}{\|}}{C}-(CH_2)_3-COOH$$

in which the acid-to-base ratio is 1 to 2.

This composition has an IP 125 test which is positive to 2%.

EXAMPLE 5

This is a composition containing 30% of triethanolamine, 30% of water and 40% of a rust-inhibiting agent which is the triethanolamine salt of the anilido glutaric acid having the formula:

$$C_6H_5NHCO(CH_2)_3COOH$$

in which the acid-to-base ratio is 1 to 2.

This composition has an IP 125 test which is positive to 2%.

EXAMPLE 6

This is a composition containing 30% of triethanolamine, 30% of water and 40% of a rust-preventing agent which is the triethanolamine salt of the N-ethyl-N-ethanolamide succinic acid having the general formula:

$$CH_3CH_2N(CH_2—CH_2OH)—CO—(CH_2)_2—COOH$$

in which the acid-to-base ratio is 1 to 2.

This composition has an IP 125 test which is positive to 2.5%.

EXAMPLE 7

This is a composition containing 30% of triethanolamine, 30% of water, and 40% of a rust-inhibiting agent which is the triethanolamine salt of the N-(polyoxyethylene)anilido adipic acid having the general formula:

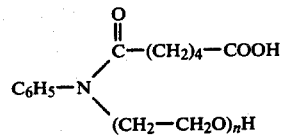

with n=5, wherein the acid-to-base ratio is 1 to 2.

This composition has an IP 125 test which is positive to 1%.

EXAMPLE 8

This is a composition comprising 30% of triethanolamine, 30% of water, and 40% of the triisopropanolamine salt of the N-ethanolanilido adipic acid having the general formula:

$$C_6H_5—N(CH_2—CH_2—OH)CO(CH_2)_4—COOH$$

wherein the acid-to-base ratio is 1 to 2.

This composition has an IP 125 test positive to 1%.

EXAMPLE 9

This composition is comprised of 30% of triethanolamine, 30% of water and 40% of the triethanolamine salt of the dodecilamino-N-(polyoxyethylene)adipic acid having the general formula:

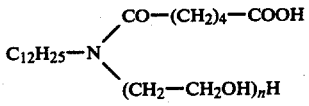

with n=5, and in which the acid-to-base ratio is 1 to 2.

This composition has an IP 125 test which is positive to 1.5%.

EXAMPLE 10

This composition contains 30% of triethanolamine, 30% of water and 40% of the triethanolamine salt of the p.nitro(N-ethanol)anilido glutaric acid having the general formula:

$$p—NO_2C_6H_4—N—(CH_2—CH_2OH)—CO—(CH_2)—COOH$$

in which the acid-to-base ratio is 1 to 2.

This composition has an IP 125 test positive to 2%.

EXAMPLE 11

This composition is comprised of 30% of triethanolamine, 30% of water and 40% of the N-oxyethylated (with 5 mols of ethylene oxide) dodecylamine of the dimethylamido maleic acid having the general formula:

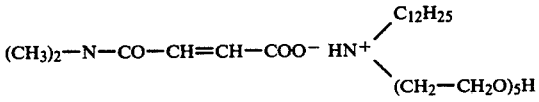

This composition has an IP 125 test which is positive to 2%.

I claim:

1. An aqueous lubricating and rust-preventing composition containing from 0.5% to 50% by weight of the water-soluble amine salt prepared from an alkanolamine and a secondary or tertiary monoamide of monoamide-alkylene carboxylic acids having the general formula,

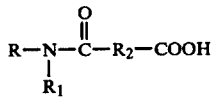

wherein R is an alkyl radical having from 1 to 18 carbon atoms, a phenyl group, a phenyl group substituted with F, Cl, Br or $NO_2$, or an alcoholic radical having from 2 to 5 carbon atoms; $R_1$ is hydrogen, an alkyl radical having from 1 to 4 carbon atoms, an alcoholic radical having from 2 to 5 carbon atoms, a polyoxyethylene group, a polyoxypropylene group, or a mixed oxyethyleneoxypropylene group having a degree of oxyethylation or oxypropylation, respectively, of from 1 to 20; and $R_2$ is an alkylene group having from 1 to 8 carbon atoms, or an alkenyl group, —CH=CH—, and from 0.1% to 20% by weight, realtive to the water-soluble amine salt, of water-soluble oxyethylated-oxypropylated polyglycols the balance being water.

* * * * *